US010786052B2

(12) United States Patent
Brandt et al.

(10) Patent No.: US 10,786,052 B2
(45) Date of Patent: Sep. 29, 2020

(54) ARTICLES INCORPORATING A COUPLED SLIDER SYSTEM

(71) Applicant: NIKE, Inc., Beaverton, OR (US)

(72) Inventors: Baron C. Brandt, Portland, OR (US); Karey Cruz, Portland, OR (US); Alice Fockele, Beaverton, OR (US); Kevin C. Sze, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 126 days.

(21) Appl. No.: 15/914,714

(22) Filed: Mar. 7, 2018

(65) Prior Publication Data

US 2018/0255883 A1 Sep. 13, 2018

Related U.S. Application Data

(60) Provisional application No. 62/469,810, filed on Mar. 10, 2017.

(51) Int. Cl.
*A44B 19/26* (2006.01)
*A41D 27/02* (2006.01)
(Continued)

(52) U.S. Cl.
CPC ..... *A44B 19/26* (2013.01); *A41D 13/0015* (2013.01); *A41D 27/02* (2013.01);
(Continued)

(58) Field of Classification Search
CPC .... A41D 13/0015; A41D 27/02; A41D 31/02; A44B 19/26; A44B 19/262
(Continued)

(56) References Cited

U.S. PATENT DOCUMENTS 2,853,758 A * 9/1958 Topf ..... A44B 19/32 24/389
3,102,570 A * 9/1963 Fairchilds ..... A44B 19/32 383/59

(Continued)

FOREIGN PATENT DOCUMENTS

KR 20130118188 A 10/2013
WO WO2013067755 5/2013

OTHER PUBLICATIONS

International Search Report and Written Opinion dated Jun. 7, 2018 in International Patent Application No. PCT/US2018/021533, 16 pages.

(Continued)

*Primary Examiner* — Gloria M Hale
(74) *Attorney, Agent, or Firm* — Shook, Hardy and Bacon LLP

(57) ABSTRACT

Aspects herein relate to a garment or article system having an internal layer and an external layer, the external layer has an inner surface facing the internal layer and an outer surface facing an external environment. Specifically, the garment or article system comprises a first slider mechanism affixed to the internal layer and a second slider mechanism affixed to the external layer. The first slider mechanism affixed to the internal layer is coupled to the second slider mechanism affixed to the external layer so that a pull or a directional force applied to the second slider mechanism is transferred to the first slider mechanism to reversibly transition the first slider mechanism from an open state in a first direction to a closed state in a second direction, and while maintaining the second slider mechanism in a closed state regardless of the direction of the directional force applied.

20 Claims, 12 Drawing Sheets

(51) Int. Cl.

| | |
|---|---|
| ***A41D 31/02*** | (2019.01) |
| ***A41D 13/00*** | (2006.01) |
| *A41D 3/00* | (2006.01) |
| *A41D 15/00* | (2006.01) |
| *A41D 27/10* | (2006.01) |
| *A41C 3/00* | (2006.01) |

(52) U.S. Cl.
CPC ..... *A41D 31/02* (2013.01); *A44B 19/262* (2013.01); *A41C 3/0028* (2013.01); *A41D 3/005* (2013.01); *A41D 15/00* (2013.01); *A41D 27/10* (2013.01); *A41D 2200/20* (2013.01); *A41D 2300/322* (2013.01)

(58) Field of Classification Search
USPC ..... 2/96, 2.17, 234–235, 270, DIG. 2
See application file for complete search history.

(56) References Cited

U.S. PATENT DOCUMENTS

| | | | | |
|---|---|---|---|---|
| 3,448,463 | A | 6/1969 | Milone | |
| 4,112,552 | A | 9/1978 | Lee | |
| 4,485,534 | A | 12/1984 | Pilie et al. | |
| 6,223,349 | B1 * | 5/2001 | Roiser | A44B 19/32 2/2.15 |
| 6,305,027 | B2 | 10/2001 | Chou | |
| 6,742,225 | B2 | 6/2004 | Marty et al. | |
| 6,792,621 | B2 | 9/2004 | Braun | |
| 6,928,703 | B2 | 8/2005 | Petravic et al. | |
| 7,039,989 | B2 | 5/2006 | Marty et al. | |
| 7,073,233 | B2 | 7/2006 | Leva et al. | |
| 7,111,328 | B2 | 9/2006 | Bay | |
| 7,114,223 | B2 | 10/2006 | Okot | |
| 7,506,417 | B2 | 3/2009 | Yoneoka | |
| 7,516,523 | B2 | 4/2009 | Okot | |
| 7,954,173 | B2 | 6/2011 | Collier | |
| 8,118,762 | B2 | 2/2012 | Bort | |
| 8,336,116 | B2 | 12/2012 | Seguin et al. | |
| 8,434,202 | B2 | 5/2013 | Matsumoto | |
| 8,819,901 | B2 | 9/2014 | Muratsabaki et al. | |
| 9,149,092 | B2 | 10/2015 | Damon et al. | |
| 2003/0177616 | A1 | 9/2003 | Petravic et al. | |
| 2004/0002288 | A1 * | 1/2004 | Bell | A41C 3/0064 450/75 |
| 2004/0055117 | A1 | 3/2004 | Marty et al. | |
| 2009/0259159 | A1 * | 10/2009 | Bell | A41C 3/0064 602/75 |
| 2012/0045967 | A1 * | 2/2012 | Punsal | A41C 3/0057 450/82 |
| 2012/0159746 | A1 * | 6/2012 | Matsumoto | A44B 19/20 24/386 |
| 2012/0210487 | A1 | 8/2012 | Albin et al. | |
| 2013/0067755 | A1 | 3/2013 | Maynard et al. | |
| 2013/0254969 | A1 | 10/2013 | Getzen et al. | |
| 2014/0295734 | A1 * | 10/2014 | Shashy | A41C 3/02 450/58 |
| 2016/0008178 | A1 | 1/2016 | Babic et al. | |
| 2017/0027235 | A1 | 2/2017 | Inzer | |

OTHER PUBLICATIONS

International Preliminary Report on Patentability dated Sep. 19, 2019 in International Patent Application No. PCT/US2018/021533, 16 pages.

* cited by examiner

ARTICLES INCORPORATING A COUPLED SLIDER SYSTEM

CROSS-REFERENCE TO RELATED APPLICATIONS

This application, assigned U.S. patent application Ser. No. 15/914,714, filed Mar. 7, 2018, and titled "Articles Incorporating a Coupled Slider System, is a Non-Provisional Application claiming priority to U.S. Provisional Patent Application No. 62/469,810, titled "Articles Incorporating a Coupled Slider System," and filed on Mar. 10, 2017. The entirety of the aforementioned application is incorporated by reference herein.

STATEMENT REGARDING FEDERALLY SPONSORED RESEARCH OR DEVELOPMENT

Not applicable.

TECHNICAL FIELD

Aspects herein relate to articles with a coupled slider system.

BACKGROUND OF THE INVENTION

Articles having two or more layers of material may pose challenges when it comes to slider systems used to selectively open or close one or more of the layers. For instance, it may be difficult to access a slider mechanism positioned on an internal layer of an article without opening the external layer first. Aspects in accordance herein provide a practical solution to this type of problem, as described in further detail, below.

BRIEF DESCRIPTION OF THE DRAWINGS

Aspects herein is described in detail below with reference to the attached drawing figures, wherein.

DETAILED DESCRIPTION OF THE INVENTION

Figure 1A:
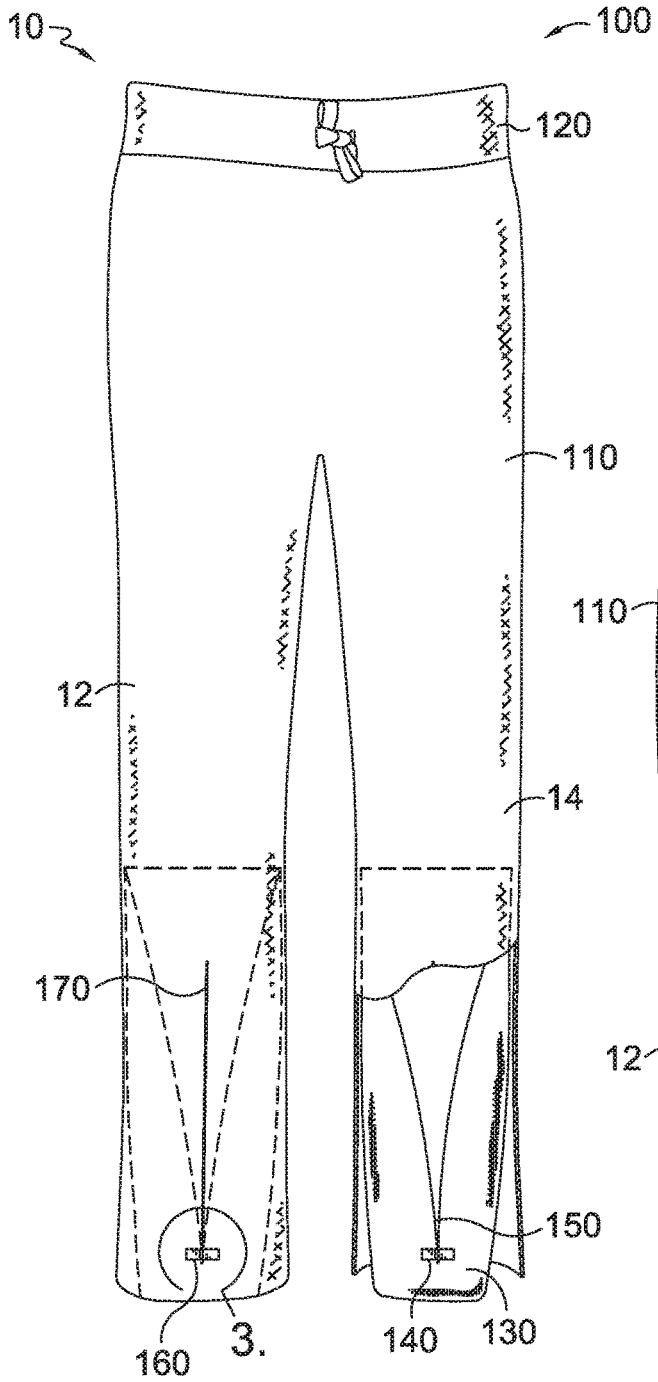
FIG. 1A depicts an exemplary lower body garment system having an exemplary coupled slider system, wherein the lower body garment system comprises a compression layer in a non-tensioned state in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

Aspects herein generally relate to a coupled slider system for use in articles having a layered construction. Exemplary articles may include articles of apparel such as apparel for an upper torso of a wearer, apparel for a lower torso of a wearer, protective apparel such as shin guards or pad systems, socks, shoes, support garments such as brassieres (i.e., bras), hoodies, as well as articles such as bags, purses, backpacks, sleeping bags, and the like. In exemplary aspects, the article may comprise an internal layer of material and an external layer of material that is positioned adjacent and external to the internal layer of material. The internal layer of material may comprise a first slider mechanism that is useable to open the internal layer of material when moved in a first direction or close the internal layer of material when moved in a second direction opposite the first direction. The first slider mechanism may be coupled to a second slider mechanism positioned on the external layer of material. The second slider mechanism may be configured to move in the first direction and the second direction opposite the first direction while still maintaining the external layer of material in a closed state. In use, a user would move the second slider mechanism positioned on the external garment layer in the first direction to cause the first slider mechanism to also move in the first direction thereby opening the internal layer of material. To close the internal layer of material, the user would move the second slider mechanism in the second direction to cause the first slider mechanism to move in the second direction. The result of using the coupled slider system is that the user can maintain the external garment layer in a closed state while still being able to open and close the internal layer of material.

Aspects herein may more particularly provide for garment system(s) comprising a layered construction at least at a portion of the garment system(s). The portion(s) of the garment system(s) that has the layered construction comprise(s), in exemplary aspects, a compression layer that is internal to an external garment layer. The compression layer in accordance with aspects herein is configured to reversibly apply pressure or tension to a body portion of a wearer when the garment is worn. The compression layer is configured to be activated and/or to apply tension via a slider mechanism secured to the external layer that is coupled to a slider mechanism secured to the compression layer. The slider mechanism positioned on the external layer comprises a bi-directional slider body mounted onto a set of slider elements, where the bi-directional slider mechanism is configured to keep the set of slider elements in a closed/engaged state, despite any directional movement of the bi-directional slider body along the set of slider elements. The slider mechanism attached to the compression layer also comprises a slider body mounted onto another set of slider elements. Unlike the slider mechanism attached to the external layer, the slider mechanism attached to the compression layer is configured to reversibly close/engage the set of slider elements thereby providing tension/compression to the body portion of the wearer and open/disengage the set of slider elements thereby releasing tension/compression of the body portion of the wearer. Because of the coupling of the slider mechanism of the external layer to the slider mechanism of the compression layer, a directional pull exerted on the slider mechanism of the external layer will be effective to either open/engage or close/disengage the set of slider elements of the slider mechanism of the compression layer.

In accordance with a first example, aspects herein disclose a garment system comprising an internal garment layer configured to reversibly apply pressure to a body part of a wearer when in a tensioned state. Further, the garment system comprises an external layer that is positioned adjacent and external to the internal garment layer. A first slider mechanism is affixed to the internal garment layer, where when the first slider mechanism is in a closed state, the internal garment layer is in the tensioned state, and when the first slider mechanism is in an open state, the internal garment layer is in a non-tensioned state. A second slider mechanism is affixed to the external layer and comprises at least a bi-directional slider body, where the bi-directional slider body is coupled to the first slider mechanism such that movement of the bi-directional slider body in a first direction causes the first slider mechanism to transition from the open state to the closed state, and movement of the bi-directional slider body in a second direction opposite the first direction causes the first slider mechanism to transition from the closed state to the open state.

In accordance with a different example, aspects herein disclose an article system comprising a first material layer having a first slider mechanism useable to transition at least a portion of the first material layer from a closed state to an open state, and from the open state to the closed state. Further, the article system comprises a second material layer positioned adjacent and external to the first material layer, where the second material layer has a second slider mechanism comprising at least a bi-directional slider body coupled to the first slider mechanism. Movement of the bi-directional slider body in a first direction causes the first slider mechanism to transition the portion of the first garment layer from the closed state to the open state, and movement of the bi-directional slider body in a second direction opposite the first direction, causes the first slider mechanism to transition the portion of the first material layer from the open state to the closed state.

In accordance with a further example, aspects herein are directed to a slider system comprising a first slider body comprising at least a first slider component facing a first direction and a second slider component facing a second direction opposite the first direction. The slider system further comprising a second slider body coupled to the first slider body, the second slider body comprising a third slider component, where when the slider system is incorporated into an article, a directional force applied to the first slider body is transferred to the second slider body causing both the first slider body and the second slider body to concurrently move in the direction of the directional force.

As briefly described above, aspects herein are directed at least to garment system(s) having at least one internal compression layer. The internal compression layer may extend through any area of the garment deemed necessary. For example, in a lower body garment, the compression layer may be provided at the leg portions of the lower body garment. Depending on the length of the lower body garment and where the compression is needed, the compression layer may be configured to reversibly apply pressure to a thigh area of the wearer, whether the lower body garment is a pair of shorts, a pair of Capri pants, a pair of long pants, and the like. Alternatively, the compression layer may be configured to reversibly apply pressure to a calf area of the wearer, whether the lower body garment is a pair of Capri pants or a pair of long pants. As well, when the lower body garment generally covers both a thigh and a calf area of the wearer, the internal compression layer may be configured to extend the whole leg length of the lower body garment. Alternatively, the lower body garment may comprise a first compression layer configured to cover a thigh area of a wearer and a second compression layer separate from the first compression layer, where the second compression layer is configured to cover a calf area of a leg of a wearer when the garment is worn. Similarly, in an upper body garment, the compression layer may be configured to exert tension to the whole or a portion of the arms of a wearer, an abdominal area of a wearer, a chest area of a wearer, and the like. Further, the garment systems in accordance with aspects herein could also be implemented in body suits configured to cover a portion (e.g. snow bibs) or the whole body of a wearer (e.g. safety suits, snow suits, hazmat suits, and the like) when the garment is worn. Any and all aspects, and any variation thereof, are contemplated as being within aspects herein.

In exemplary aspects, the internal compression layer may be generally formed from an elastically resilient material having two-way stretch and/or four-way stretch that exhibits a first modulus of elasticity such as, for example, a power mesh material, elastane, and the like. However, it is also contemplated herein that when the coupled slider system is used in a layered article such as a bag, the inner layer may comprise a less elastically resilient and/or non-elastically resilient material, which may also be used for an outer layer, having a second modulus of elasticity that is greater than the first modulus of elasticity described above for an elastically resilient material. As described above, the slider mechanism of the compression layer may generally comprise a slider body and a set of slider elements. The slider body of the compression layer may comprise a front portion and a back portion (also known as a first portion and a second portion) where one of the front portion or the back portion may be configured to close or engage the set of slider elements when a directional force is applied in a first direction, and the other of the front portion or the back portion of the slider body may be configured to open or disengage the set of slider elements when a directional force is applied in a second direction that is opposite to the first direction. The slider mechanism in accordance with aspects herein may include, for example, zippers with zipper teeth, zippers with no zipper teeth (i.e. a zip and lock by the application of pressure type), hook and loop, and any other mechanism that may be quickly closed and opened with a unitary motion.

The external layer may be generally formed from an elastically resilient material, a non-elastically resilient material, a material that comprises a mixture of elastic and non-elastic materials, a knit material, a woven material, a braided material, a non-woven material, and the like. The materials may comprise natural fibers such as wool, cotton, hemp, silk, and the like, or, the materials may comprise synthetic fibers such as polyester, rayon, nylon, and the like, or a mixture of natural and synthetic fibers. The materials may also comprise thermoplastic materials, felt type materials, leather, paper, and the like. The materials may comprise different types of coatings such as DWR (durable water repellent), rubber, thermoplastic, metallic, and the like. In other words, depending on the type of garment or article being formed, the materials used for the external layer are only limited by the types of materials available in the market place. In some aspects, the material used for the external layer may be chosen from materials having a greater modulus of elasticity than the internal layer. Furthermore, the external layer may be formed of two or more material layers. As well, the external layer may comprise thermal properties by comprising thermally insulating materials quilted or otherwise provided to the external layer, such as, for example, down, thermally insulating synthetic fibers, thermally insulating synthetic fiber sheets, or any combination of these. Any and all aspects, and any variation thereof, are contemplated as being within aspects herein.

As briefly described above, the slider mechanism of the external layer may also generally comprise a slider body and a set of slider elements. The slider body of the external layer may comprise a front portion and a back portion (also known as a first portion and a second portion) where both of the front portion and the back portion may be configured to close or engage the set of slider elements when a directional force is applied in a first direction and an opposite second direction. In other words, regardless of a direction of the directional force (e.g. directional pull), the set of slider elements of the external layer remain in a closed configuration.

Further, as described, aspects herein are directed to article systems having a layered construction with an internal layer and an external layer. In exemplary aspects, the internal layer has a first slider mechanism having a first slider body and a first set of slider elements, where the first slider mechanism may be configured to reversibly transition from an open state to a closed state. The first slider mechanism may be mechanically coupled to a second slider mechanism located on the external layer, where the second slider mechanism may be configured to transmit a directional force applied to a second slider body of the second slider mechanism, to the first slider body of the first slider mechanism while remaining in a closed configuration. That is, the second slider mechanism may cause the first slider mechanism to transition from an open state to a closed state and vice versa without exposing at least a portion of an interior of the article system, regardless of the direction in which the directional force is applied.

As an example, the article system may be a sleeping bag having one or more internal layers, each internal layer having the first slider mechanism described above coupled to a respective second slider mechanism on the external layer. The sleeping bag may be configured to snuggly fit an adult or a child, for example, by opening or closing the first slider mechanism via the second slider mechanism on the external layer. In another exemplary aspect, the article system may be a carrying bag with an internal compartment that may be reversibly decreased or increased in size via the first slider mechanism on an internal layer of the bag and the second slider mechanism on an external layer of the bag. In yet another example, the article may comprise a shoe system with an internal liner (e.g., an elastically resilient internal liner) and an external shell layer, where the internal liner may be reversibly opened or closed via a coupled slider system as described above. This may be useful in providing additional support during certain activities. Further, the article may comprise a bra type garment having an external layer and an internal layer, where the internal layer may be configured to reversibly apply an increased tension to provide additional support during certain activities. Furthermore, the article may comprise a hood or any other type of head gear having a layered construction in accordance with aspects herein, where the internal layer may be configured to reversibly tighten the hood or head gear to provide a more snug fit when desired. These are only exemplary and it is envisioned that aspects herein may be employed to many other non-apparel type articles of manufacture without departing from the scope of this disclosure.

Moving on to the figures, FIG. 1A depicts an exemplary lower body garment system 10 comprising a compression layer 130 being in an open/non-tensioned state 100 in accordance with aspects herein. In the exemplary lower body garment system 10 depicted in FIG. 1A, the compression layer 130 is configured to reversibly apply pressure to a calf area of a wearer when the exemplary lower body garment system 10 is worn. However, it is contemplated that the compression layer 130 may extend higher up and be configured to exert pressure up to and including a thigh area of a wearer, or the compression layer 130 may be located only in a thigh area of the exemplary lower body garment system 10, or the exemplary lower body garment system 10 may comprise two or more compression layers 130 to separately and reversibly exert pressure at different sections of the exemplary lower body garment system 10. Further, although the exemplary lower body garment system 10 is depicted as being a long pair of pants, the pant length may be varied according to style and need.

The exemplary lower body garment system 10 may comprise a waistband 120 and an external garment layer 110 that is configured to cover/hide the compression layer 130 so that the compression layer 130 is generally not visible when the exemplary lower body garment system 10 is worn by a wearer. In other words, the external garment layer 110 is positioned adjacent and external to the compression layer 130. However, it is contemplated herein that there may be garment systems that at least partially expose portions of the compression layer 130. There may be several different ways in which the compression layer 130 may be coupled to the external garment layer 110. For example, the compression layer 130 may be coupled to the external garment layer 110 through an extra piece of material/gusset at one or both ends of the compression layer 130, as shown in FIGS. 9A and 9B or, the compression layer 130 may be coupled to the external garment layer 110 at particular stitch points or, the compression layer 130 may be coupled to the external garment layer 110 through elastic or inelastic extensions, as shown in FIGS. 10A and 10B.

Figure 9A:
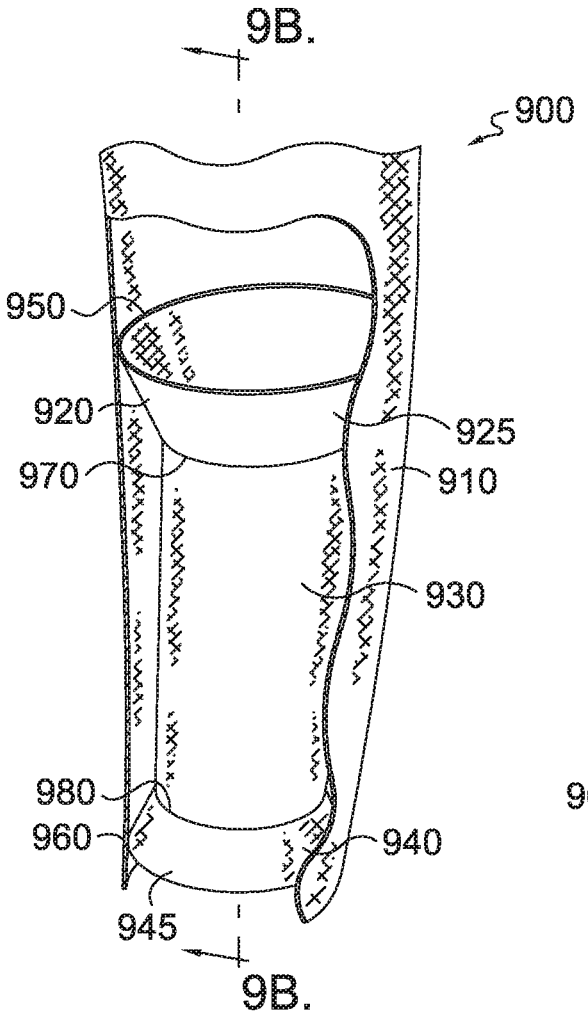
FIG. 9A depicts a cut away view of a portion of a garment system in accordance with aspects herein.
Figure 9B:
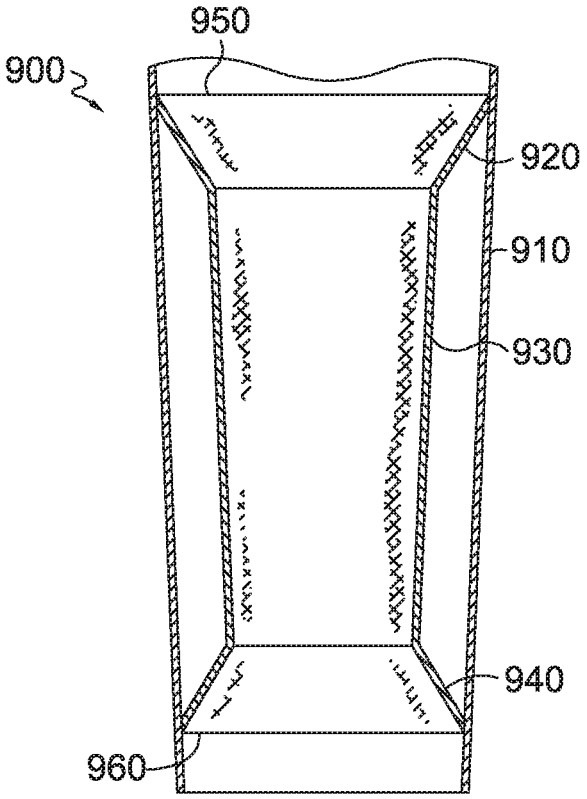
FIG. 9B depicts a cross-sectional view along the line 9B-9B in FIG. 9A, in accordance with aspects herein.

FIG. 9A shows a cutaway view of a garment system 900, and FIG. 9B shows a cross-sectional view along the line 9B-9B in FIG. 9A, in accordance with aspects herein. FIGS. 9A and 9B depict how an external garment layer 910 may be coupled to a compression layer 930 in a garment system 900 in accordance with aspects herein. The external garment layer 910 may be coupled to a first piece of material/gusset 920 at a first seam 950 at a first end 925, and the first piece of material/gusset 920 may be coupled to the compression layer 930 at a second seam 970 at the first end 925. Optionally, the external garment layer 910 may be further coupled to a second piece of material/gusset 940 at a third seam 960 at a second end 945, and the second piece of material/gusset 940 may be coupled to the compression layer 930 at a fourth seam 960 at the second end 945. Use of the material/gussets 920 and 940 may allow for some amount of "de-coupling" of the compression layer 930 from the external garment layer 910 so that the compression layer 930 does not exert an undue amount of tension or strain on the external garment layer 910 as may occur, for instance if the edges of the compression layer 930 were directly affixed to the external garment layer 910.

Figure 10A:
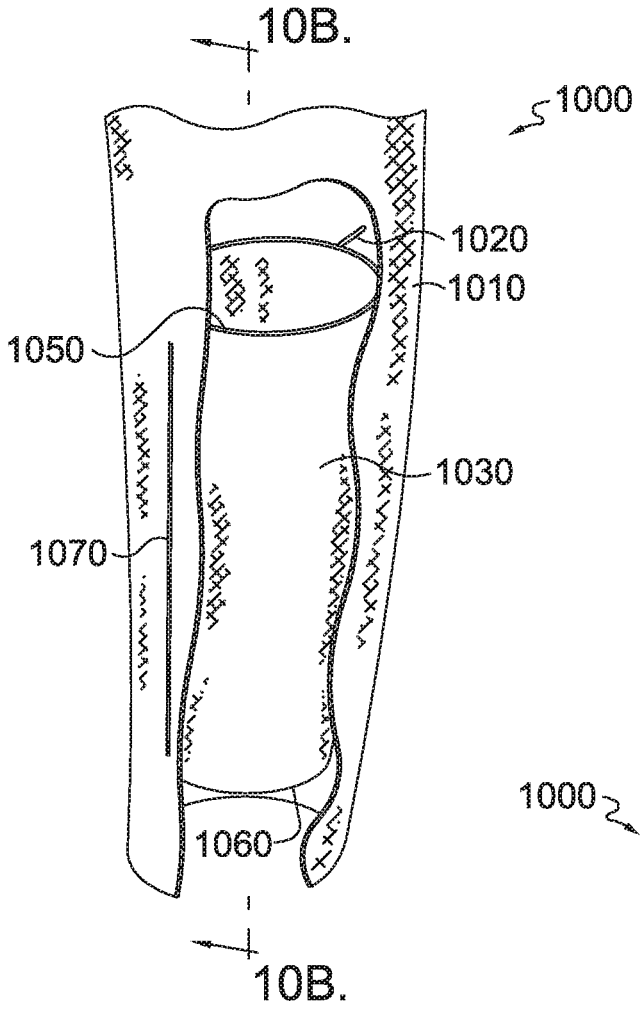
FIG. 10A depicts a cut away view of a portion of a different garment system, in accordance with aspects herein.
Figure 10B:
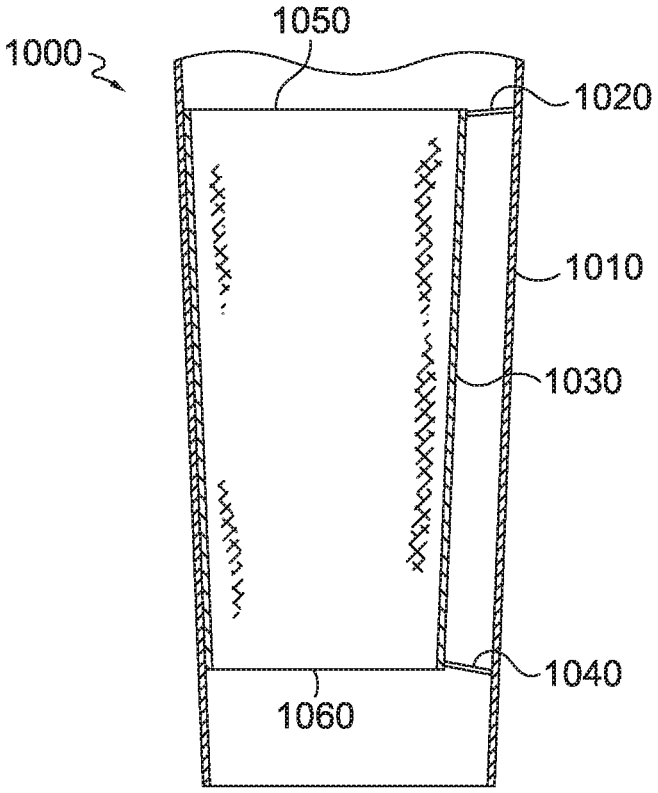
FIG. 10B depicts a cross-sectional view along the line 10A-10A in FIG. 10A, in accordance with aspects herein.

FIG. 10A shows a cutaway view of a garment system 1000, and FIG. 10B shows a cross-sectional view along the line 10B-10B in FIG. 10A, in accordance with aspects herein. FIGS. 10A and 10B depict an additional way how an external garment layer 1010 may be coupled to a compression layer 1030 in a garment system 1000 in accordance with aspects herein. The external garment layer 1010 may be coupled to the compression layer 1030 through at least a first extension 1020 at a first end 1050. Optionally, the external garment layer 1010 may be further coupled to the compression layer 1030 through at least a second extension 1040 at a second end 1060 (best seen in FIG. 10B). Similar to the material gussets 920 and 940 of FIGS. 9A and 9B, use of the extensions 1020 and 1040 helps to de-couple the compression layer 1030 from the external garment layer 1010 and helps to minimize the amount of tension or strain imposed on the external garment layer 1010. The slider mechanism 1070 may be used to reversibly activate the compression layer 1030 in accordance with aspects herein.

Returning to FIG. 1A, as seen on the view of the first leg 12 of the exemplary lower body garment system 10, which depicts the compression layer 130 in dashed lines to indicate it is hidden from view, the external garment layer 110 comprises a slider mechanism comprising a slider body 160 and a set of slider elements 170. The slider mechanism on the external garment layer 110 is configured to remain in a closed configuration regardless of the position of the slider body 160 on the set of slider elements 170. As such, the compression layer 130 remains hidden by the external garment layer 110. Further, as seen on the view of the second leg 14 of the exemplary lower body garment system 10, which depicts a portion of the external garment layer 110 cut away, the compression layer 130 also comprises a slider mechanism with a slider body 140 and a set of slider elements 150. As explained more fully below, the slider body 160 of the external garment layer 110 is coupled to the slider body 140 of the compression layer 130 so that a wearer may operate the exemplary lower body garment system 10 by interacting with just the slider body 160. To put it another way, the wearer need not move the external garment layer 110 out of the way to access the slider body 140 of the compression layer 130. To put it yet another way, any force or pull on the slider body 160 is transferred to the slider body 140 so that, for example, when a wearer pulls in a first direction (e.g. downward) on the slider body 160, the slider body 140 is also moved in the first direction, and when the wearer pulls in a second direction (e.g. upward) on the slider body 160, the slider body 140 is also moved in the second direction. However, unlike the slider body 160 of the external garment layer 110, the slider body 140 is configured to open and close the set of slider elements 150 on the compression layer 130. Therefore, when the set of slider elements 150 are open (as shown in FIG. 1A), the compression layer 130 is in its non-tensioned state, and when the set of slider elements 150 are closed (as shown in FIG. 1B), the compression layer 130 is in its tensioned state.

Figure 8A:
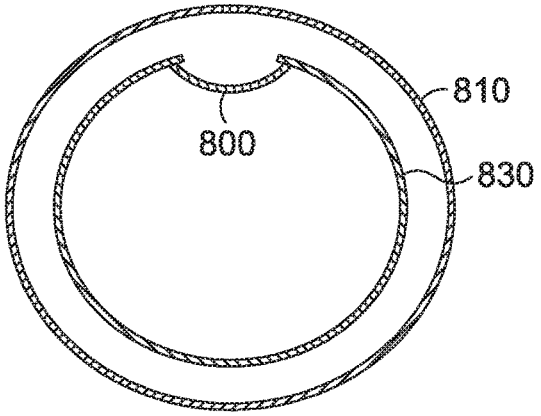
FIG. 8A depict an exemplary cross-sectional view of a garment system having an exemplary coupled slider system that utilizes a gusset, in accordance with aspects herein.
Figure 8B:
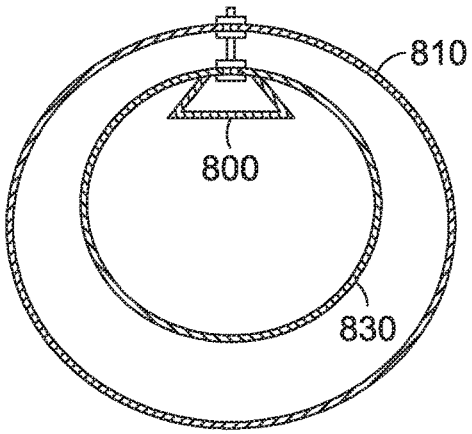
FIG. 8B depicts an exemplary cross-sectional view of a garment system having an exemplary coupled slider system that utilizes a different gusset, in accordance with aspects herein.

In order to improve the feel of the compression layer 130, in particular, where the slider mechanism with the slider body 140 and slider elements 150 is located, a gusset as shown in FIGS. 8A and 8B, may be included so that the slider mechanism with the slider body 140 and the set of slider elements 150 is not in direct contact with the wearer when the garment is worn. The gusset may extend between the edges of the opening defined by the slider elements 150 and, if included, may be comprised of the same material as the compression layer 130, or may be comprised of any other suitable soft material that may have, for instance, moisture management properties and a soft feel. FIGS. 8A and 8B depict cross-sectional view of a garment system in accordance with aspects herein. As shown in FIG. 8A, the gusset 800 may be extended when the compression layer 830 is in its non-tensioned state (i.e., an open state) while the external layer 810 remains in its original configuration, and as shown in FIG. 8B, the gusset 800 may be folded when the compression layer 830 is its tensioned state (i.e., closed state) while the external layer 810 still remains in its original configuration.

Returning again to FIG. 1, although only one slider mechanism is depicted for compression layer 130, it is contemplated that the compression layer 130 may have one or more slider mechanisms in order to impart a variable level of compression. In other words, the tensioning ability of the compression layer 130 may be increased or decreased by selectively opening and/or closing the one or more slider mechanisms of compression layer 130, with the least amount of pressure or tension resulting when all slider mechanisms are in an open state, and the greatest amount of pressure or tension resulting when all slider mechanisms are in a closed state. As well, if a gusset is provided, a size (width) covered by the gusset may also play a role in the tensioning level, depending on how far apart the corresponding slider elements are allowed to separate when they are in an open/non-tensioned state.

Figure 1B:
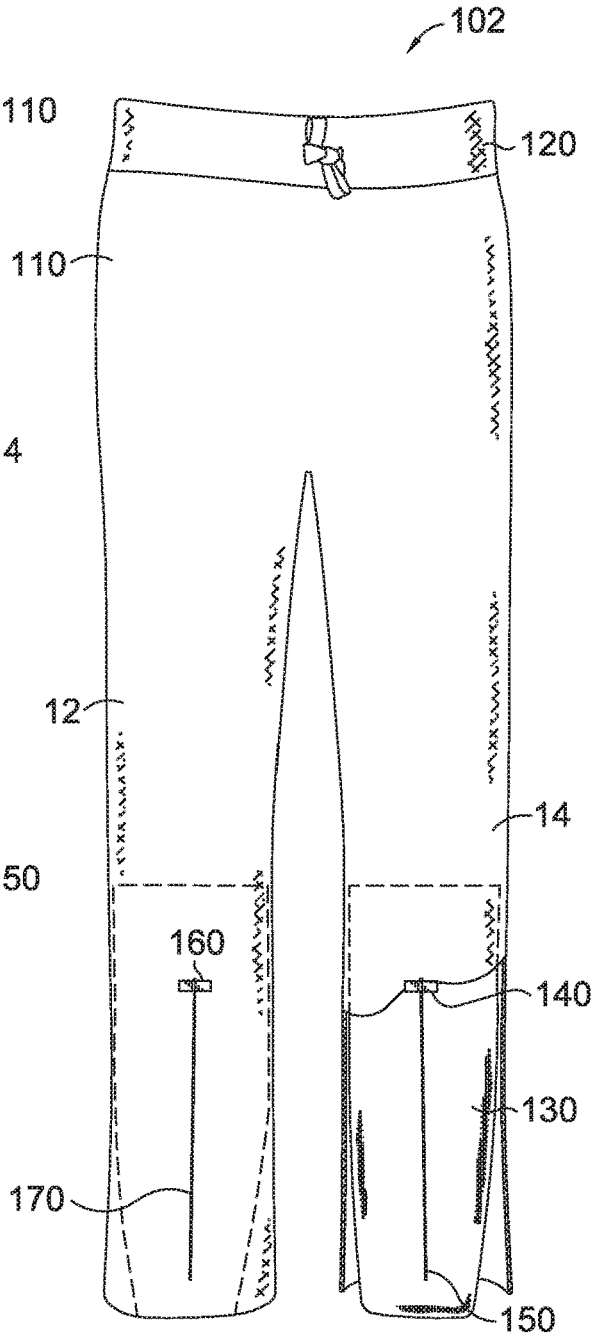
FIG. 1B depicts the exemplary lower body garment system of FIG. 1A with the compression layer in a tensioned state in accordance with aspects herein.

FIG. 1B depicts the exemplary lower body garment system 10 in a closed/tensioned state 102. As it can be observed, the slider mechanism on the external garment layer 110 remains in a closed configuration even when a position of the slider body 160 on the set of slider elements 170 has been changed. (i.e., as shown in the view of the first leg 12). However, as described above and due to the coupling between the slider bodies 140 and 160, the movement of the slider body 160 on the external garment layer 110 has caused movement of the slider body 140 of the compression layer 130, which has caused the set of slider elements 150 to become closed, thereby activating the compression layer 130 so that it can exert pressure on, in this example, a calf of the wearer, when the exemplary lower body garment system 10 is worn.

Figure 2A:
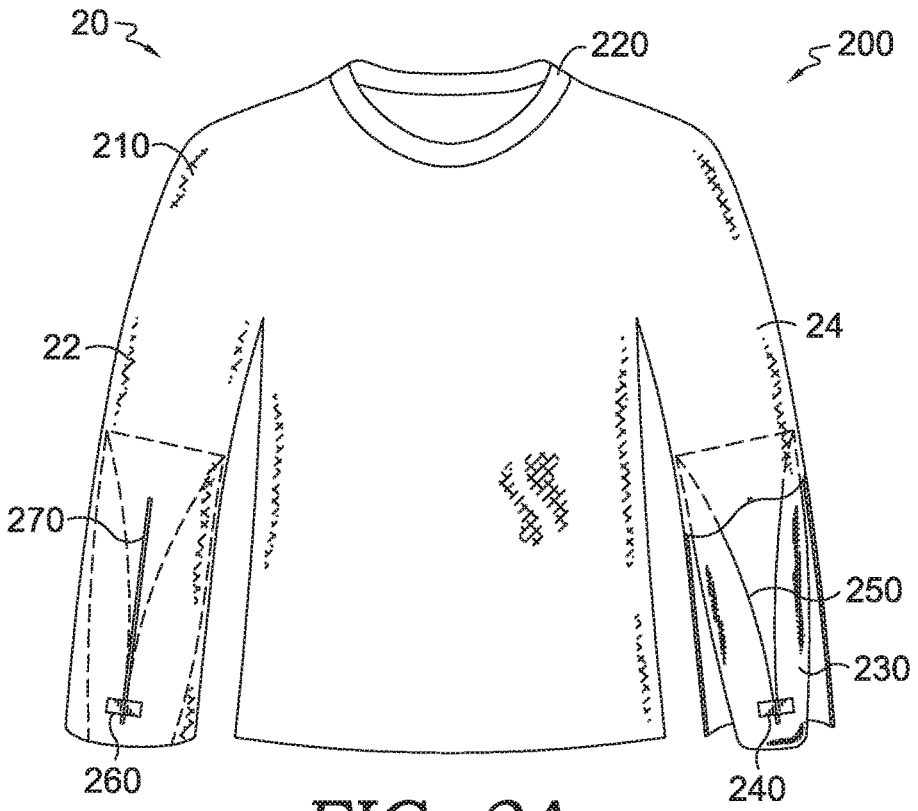
FIG. 2A depicts an exemplary upper body garment system having an exemplary coupled slider system, wherein the upper body garment system comprises a compression layer in a non-tensioned state in accordance with aspects herein.

FIG. 2A depicts an exemplary upper body garment system 20 comprising a compression layer 230 in an open/non-tensioned state 200 in accordance with aspects herein. The exemplary upper body garment system 20, although depicted as comprising a compression layer only in a forearm region of the exemplary upper body garment system 20, may also comprise additional compression layers for reversibly providing compression to different upper body parts of a wearer such as a whole arm, upper arm separate from a forearm, a chest area, an abdominal area, and depending on the length of the exemplary upper body garment system 20, a lower abdominal area of a wearer, and the like.

Figure 2B:
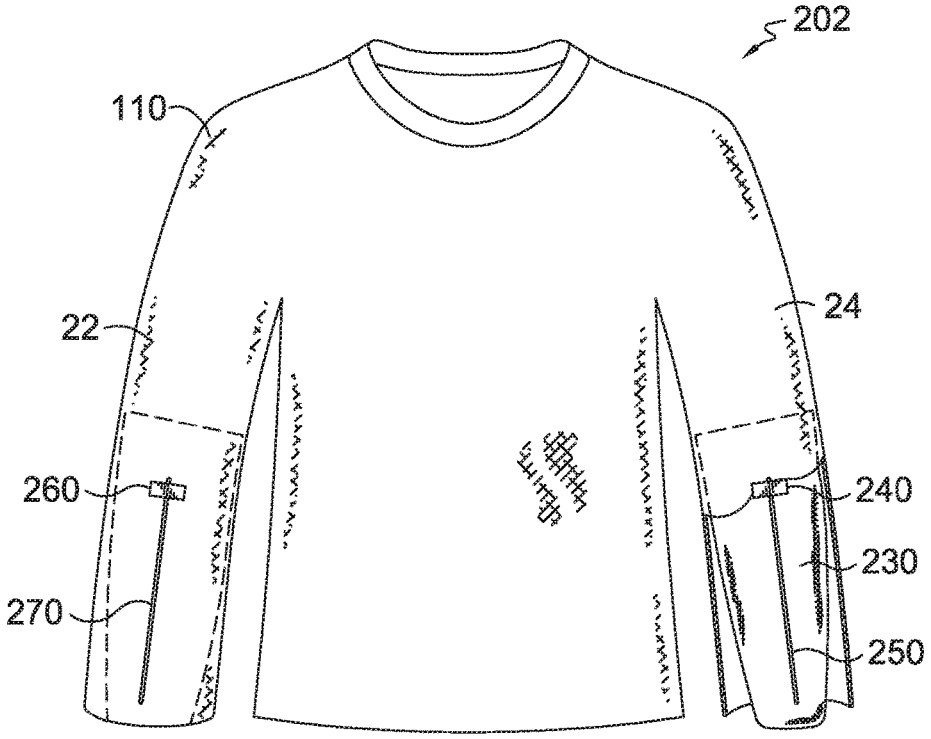
FIG. 2B depicts the exemplary upper body garment system of FIG. 2A with the compression layer in a tensioned state in accordance with aspects herein.

The exemplary upper body garment system 20 may comprise a collar 220, an external garment layer 210, and a compression layer 230. Similar to what was described above with respect to exemplary lower body garment system 10, the exemplary upper body garment system 20 comprises a slider mechanism on the external garment layer 210 with a slider body 260 and a set of slider elements 270 which, as seen in the view of the first sleeve 22 in FIGS. 2A and 2B, remains in a closed state regardless of a position of the slider body 260 on the set of slider elements 270. On the other hand, as seen in the cut away view of the second sleeve 24, when the slider body 240 of the slider mechanism of the compression layer 230 is in a first position on the set of slider elements 250, the slider elements 250 are in an open state, and as seen in the cut away view of second sleeve 24 in FIG. 2B, the slider elements 250 transition to a closed/tensioned state when the slider body 240 is moved to a second position on the set of slider elements 250.

Figure 3:
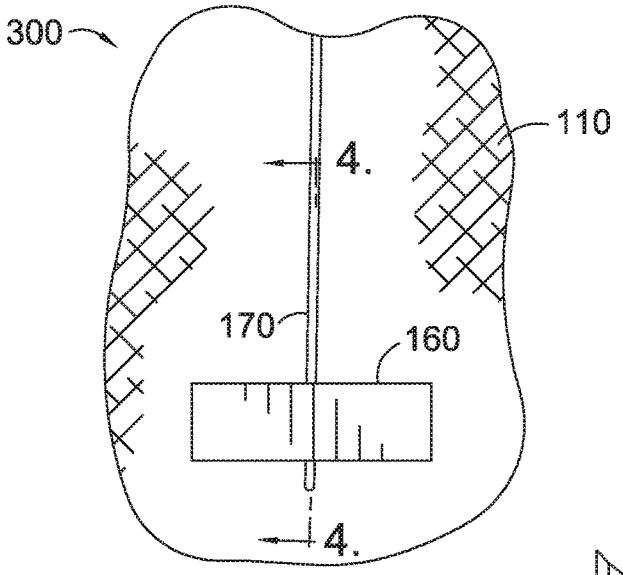
FIG. 3 depicts a close up view of a slider mechanism of the exemplary coupled slider system, where the slider mechanism is attached to the external garment layer of the garment system shown in FIG. 1A as indicated by the numeral 3 in FIG. 1A.
Figure 4:
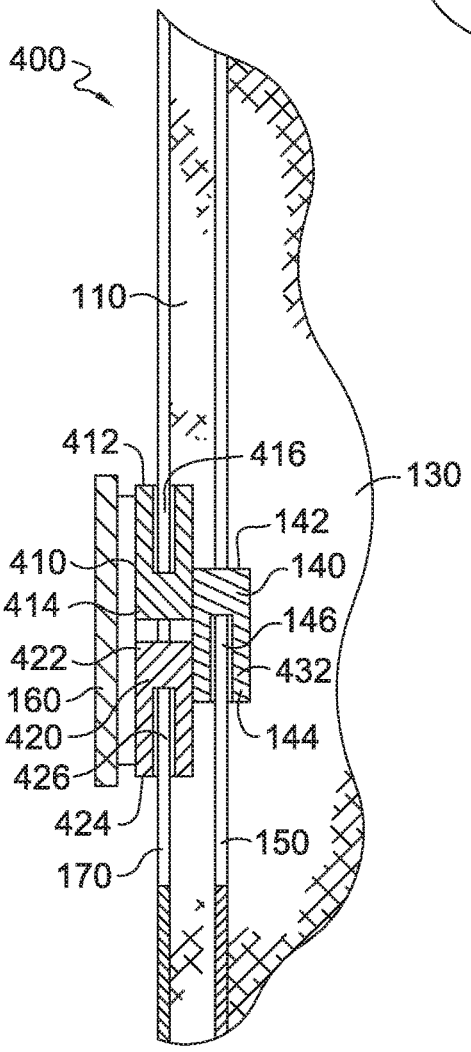
FIG. 4 depicts an exemplary cross-sectional view of the exemplary coupled slider system taken along line 4-4 in FIG. 3, in accordance with aspects herein.

FIG. 3 shows a close up view of the slider mechanism with slider body 160 and the set of slider elements 170, attached to the external garment layer 110 of the exemplary lower body garment system 10 shown in FIG. 1A, as marked by the numeral 3 in FIG. 1A. FIG. 4 depicts an exemplary configuration for a slider mechanism on the external garment layer 110 as coupled to a slider mechanism on the compression layer 130. In particular, FIG. 4 is a cross-sectional view 400 along the line 4-4 in FIG. 3. As more clearly seen in FIG. 4, the slider mechanism of the external garment layer 110 and the slider mechanism of the compression layer 130 are in an overlapping relation to one another, with the set of slider elements 150 being substantially parallel to (and offset from) the set of slider elements 170. As shown, in exemplary aspects, the slider body 160 may be comprised of two slider components 410 and 420 facing in opposite directions so that a receiving opening 416 of the slider component 410 is facing in a first direction, and a receiving opening 426 of the slider component 420 is facing in an opposite second direction. Both the receiving opening 416 and the receiving opening 426 are configured to receive the set of slider elements 170.

Each slider component 410 and 420, respectively, comprises a respective front portion 414/422, and a back portion 412/424. The front portions 414 and 422 of slider components 410 and 420 respectively, may be configured to separate the set of slider elements 170, while the back portions 412 and 424 of slider components 410 and 420 respectively, may be configured to engage or unite the set of slider elements 170. Thus, as the slider body 160 is pulled in a first direction, for example, upward, the slider component may 410 may be configured to open/disengage the set of slider elements 170, while simultaneously, the slider component 420 may be configured to close/engage the set of slider elements 170, and vice versa when the slider body 160 is pulled in a second direction, for example, downward. Therefore, slider body 160 is a bi-directional slider body such that the set of slider elements 170 is maintained in a constant closed/engaged configuration regardless of a direction in which the slider body 160 is pulled. Although the slider body 160 is depicted as comprising two separate slider components 410 and 420, it is envisioned that the slider components 410 and 420 may have a unitary construction, or in other words, be formed as a single or monolithic piece.

As further depicted in FIG. 4, the compression layer 130 comprises a slider body 140 that functions as a slider component 432. The slider components 410 and 420 and the slider component 432 may be directly coupled to each other, as shown. As in slider components 410 and 420, slider component 432 comprises a front portion 142, a back portion 144, and a receiving opening 146 for receiving the set of slider elements 150 of the compression layer 130. Since slider component 432 is directly coupled to slider components 410 and 420 it is contemplated that the slider body 160 and the slider body 140 may comprise a bi-partite construction or it may comprise a unitary/monolithic construction. Thus, when a directional force is applied to the slider body 160, all slider components 410, 420, and 432 may be caused to move concurrently, and since slider component 432 is unidirectional, it will cause the set of slider elements 150 to open or close, depending on the directional force exerted on the slider body 160. As such, the slider body 140, although hidden by external garment layer 110, may be configured to tension or release tension on the compression layer 130 by applying a directional force to the slider body 160.

Figure 5:
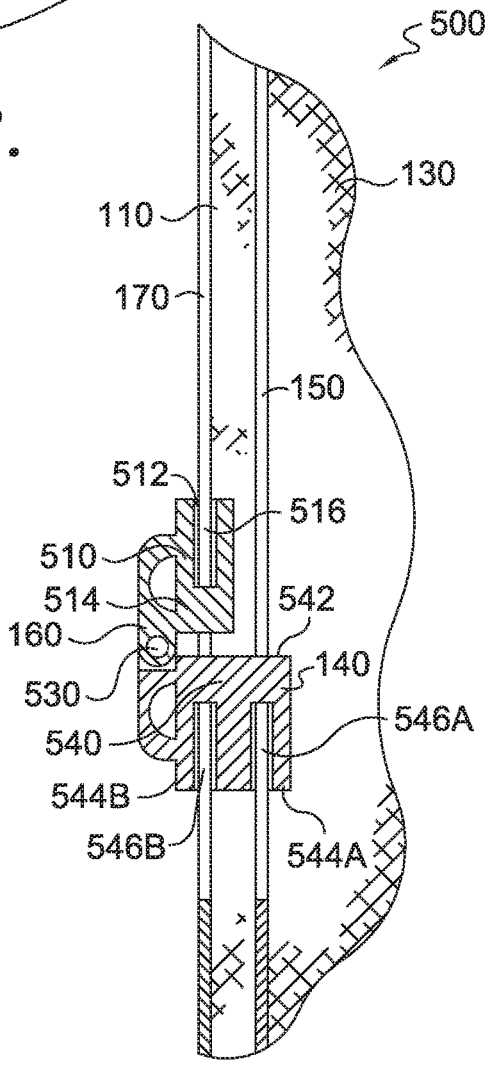
FIG. 5 depicts an alternative cross-sectional view of an exemplary coupled slider system, in accordance with aspects herein.

FIG. 5 depicts a cross-sectional view 500 of an alternative configuration of the slider mechanisms in accordance with aspects herein. The slider body 160 in FIG. 5 comprises two slider components 510 and 540, connected to each other at, for example, a coupling region 530, which may be configured to receive a slider pull (not shown) for an easy access for operation of the slider mechanism in accordance with aspects herein. The slider body 140 for the slider mechanism of the compression layer 130, in this example, is shown as being part of (i.e. one piece with) the slider component 540 of slider body 160. In other words, the slider component 540 comprises both the slider body 140 and one portion of the slider body 160. The slider component 540 may be formed of a unitary or monolithic construction with slider body 140, and then later coupled to the slider component 510 via the coupling region 530. Similar to FIG. 4, the slider body 160 is a bi-directional slider body where slider components 510 and 540 each comprise a front portion 514 and 542, respectively, that are facing each other. Further, as in FIG. 4, the slider pull 510 comprises a back portion 512 with a receiving opening 516 for receiving the set of slider elements 170 of the external garment layer 110. Slider component 540, on the other hand, comprises a back portion 544A with receiving opening 546A for receiving the set of slider elements 150 of the compression layer 130, and a back portion 544B with receiving opening 546B for receiving the set of slider elements 170.

Figure 6:
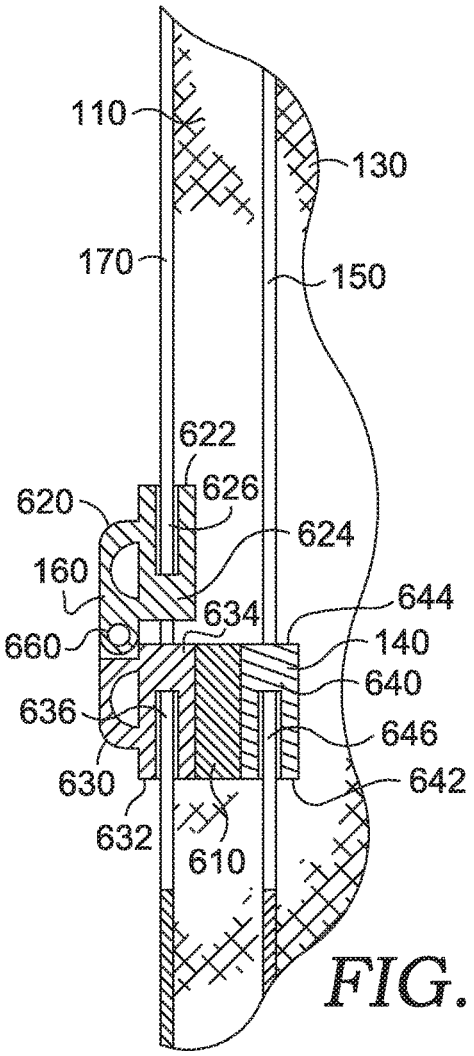
FIG. 6 depicts another alternative cross-sectional view of an exemplary coupled slider system, in accordance with aspects herein.

FIG. 6 depicts a cross-sectional view of another exemplary configuration for the slider mechanism in accordance with aspects herein. The slider body 160 in FIG. 6 comprises two slider components 620 and 630, connected to each other at, for example, a coupling region 660, which may be configured to be receive a slider pull (not shown). The slider body 140 for the slider mechanism of the compression layer 130, in this example, is shown as being spaced apart from the slider component 630 by a spacer 610. The spacer 610 may be of any suitable material and shaped and sized as necessary for an optimal operation of the slider mechanism in accordance with aspects herein. For example, the spacer 610 may be comprised of a foam, fabric, textile, metal, felt, or similar material. Use of the spacer 610 may further help to "de-couple" the compression layer 130 from the external garment layer 110. For instance, use of the spacer 610 helps to space apart the compression layer 130 from the external garment layer 110 so that the compression layer 130 does not unduly exert tensioning forces on the external garment layer 110 via the slider mechanism.

Similar to FIG. 5, the slider body 160 is a bi-directional slider body where slider components 620 and 630, each comprise a front portion 624 and 634, respectively, that are facing each other, and back portions 622 and 632 that are facing away from each other with receiving openings 626 and 636, respectively, for receiving the set of slider elements 170. Further, as in FIG. 5, the slider components 640 doubles as the slider body 140 and comprises a front portion 644 and a back portion 642 with a receiving opening 646 for receiving the set of slider elements 150 of the compression layer 130.

Figure 7:
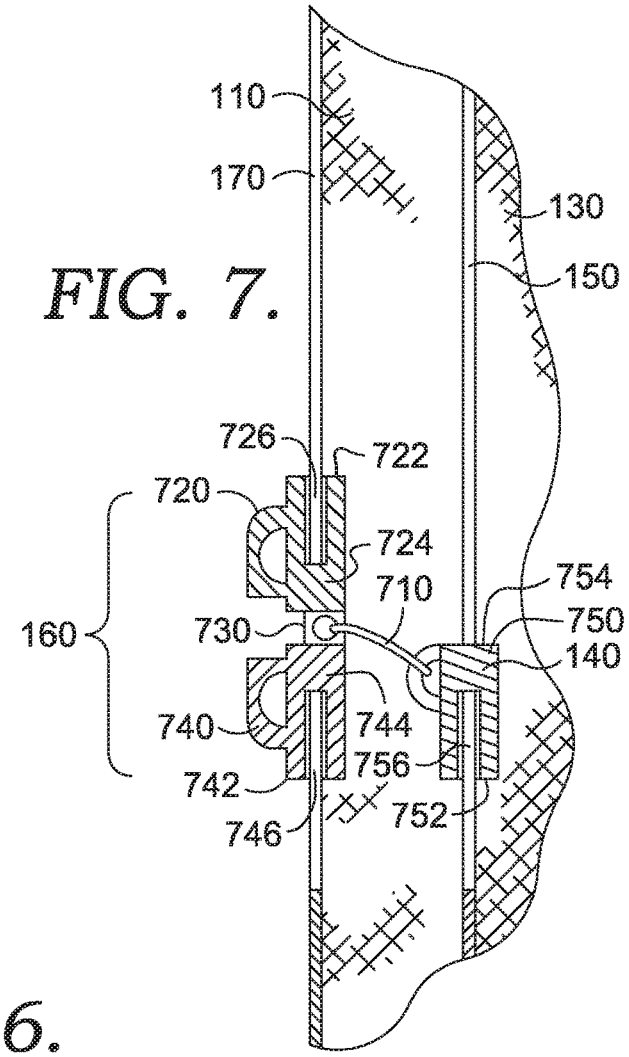
FIG. 7, depicts a further alternative cross-sectional view of an exemplary coupled slider system, in accordance with aspects herein.

FIG. 7 depicts a cross-sectional view for yet another exemplary configuration for the slider mechanisms in accordance with aspects herein. The slider body 160 in FIG. 7 comprises two slider components 720 and 740, connected to each other at, for example, a coupling region 730, which may be configured to receive a slider pull (not shown) and, which may further serve as a connection point for a cord like element 710 that acts as a connector between slider body 140 and slider body 160 at coupling region 730 of slider body 160. In other words, the slider body 140 for the slider mechanism of the compression layer 130, in this example, is spaced apart from the slider body 160 by the cord like element 710, which provides a more flexible or less rigid spacer than the one depicted in FIG. 6, for example. The cord like element 710 may be of any suitable material and shaped and sized as necessary for an optimal operation of the slider mechanism in accordance with aspects herein. Similar to FIG. 6, the slider body 160 is a bi-directional slider body where slider components 720 and 740, each comprise a front portion 724 and 744, respectively, that are facing each other, and back portions 722 and 742 that are facing away from each other with receiving openings 726 and 746, respectively, for receiving the set of slider elements 170. Further, as in FIG. 6, the slider body 140 doubles as the slider component 750 which, comprises a front portion 754 and a back portion 752 with a receiving opening 756 for receiving the set of slider elements 150 of the compression layer 130.

Figure 11:
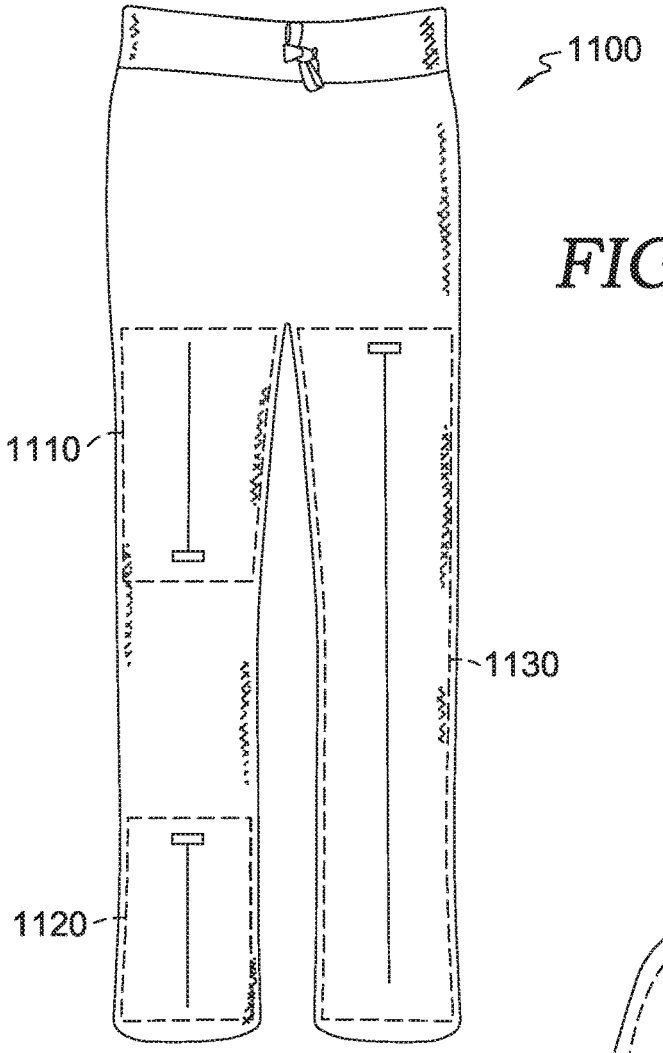
FIG. 11 depicts an exemplary lower body garment system depicting different exemplary locations for an exemplary coupled slider system, in accordance with aspects herein.

FIGS. 11-14 depict different types of garment systems in accordance with aspects herein. The internal layers are shown in dashed lines to show their hidden configuration when viewed from an exterior of the garment systems. For example, FIG. 11 depicts a lower body garment system 1100 depicting different locations and configurations for a reversibly activatable internal layer in accordance with aspects herein. For example, the lower body garment system 1100 may comprise a reversibly activatable internal layer 1110 configured to provide tensioning to a thigh area of a wearer when the lower body garment system 1100 is worn and when the internal layer 1110 is activated (closed/tensioned state). Alternatively, the lower body garment system 1100 may comprise a reversibly activatable internal layer 1120 configured to provide tensioning to a calf area of a wearer when the lower body garment system 1100 is worn and when the internal layer 1120 is activated. In yet a different example, the lower body garment system 1100 may comprise a reversibly activatable internal layer 1130 configured to provide tensioning to an entire leg of a wearer when the lower body garment system 1100 is worn and when the internal layer 1130 is activated. Further, it is contemplated that the internal layers 1110, 1120, or 1130 may be removable and interchangeable where instead of being permanently coupled to the external layer of the lower body garment system 1100 by seams, they may be coupled by, for example, a hook and loop mechanism, buttons, zippers, and the like. Thus, a user may be able to customize the lower body garment system 1100 according to his/her needs. In other words, each leg of the lower body garment system 1100 may be customized independently from the other leg to meet the needs of the user.

Figure 12:
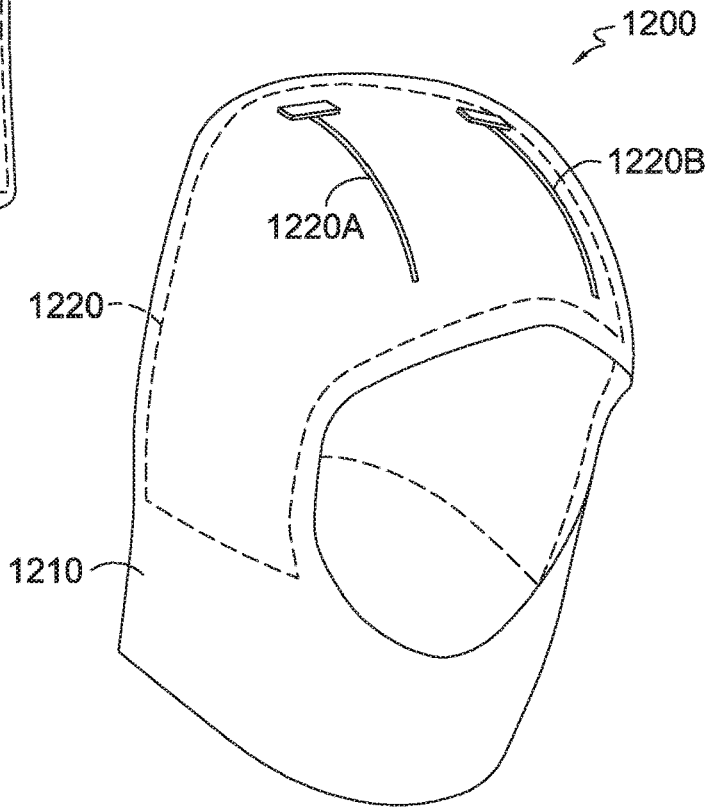
FIG. 12 depicts an exemplary head garment system having an exemplary coupled slider system, in accordance with aspects herein.

FIG. 12 depicts a head gear system 1200 in accordance with aspects herein. The head gear system 1200 may comprise an external layer 1210 and an internal layer 1220 (shown in dashed lines to indicate it is hidden from view). The fit of the head gear system 1200 may be adjusted or customized by opening or closing the slider mechanisms 1220A and/or 1220B to increase or decrease the tension or support provided by the internal layer 1220. Although the head gear system 1200 is shown as comprising two slider mechanisms 1220A and 1220B, it is contemplated that the head gear system 1200 may comprise only one slider mechanism, or may comprise more than two slider mechanisms, depending on the level of adjustability desired for the head gear system 1200.

Figure 13:
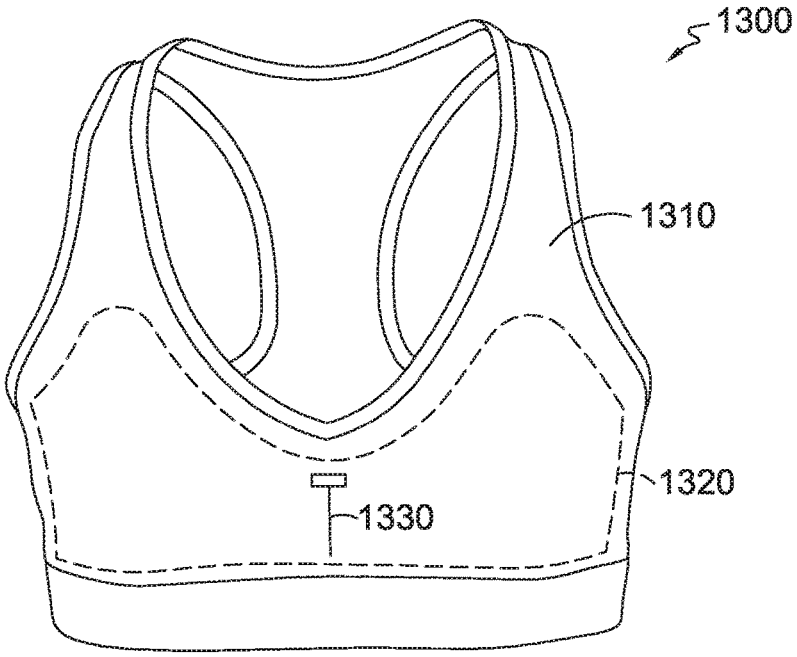
FIG. 13 depicts an upper body garment system having an exemplary coupled slider system, in accordance with aspects herein.

FIG. 13 depicts a support garment system 1300 in accordance with aspects herein, and configured to provide varying levels of support when the support garment system 1300 is in an as worn configuration. The support garment system 1300 may comprise an external layer 1310 and an internal layer 1320 shown by dashed lines to indicate that it is hidden from view. As in the other garment types described, the support garment system 1300 may comprise a slider mechanism 1330 coupling the external layer 1310 and the internal layer 1320 to transition the internal layer 1320 from a tensioned state to a non-tensioned state and vice versa.

Figure 14:
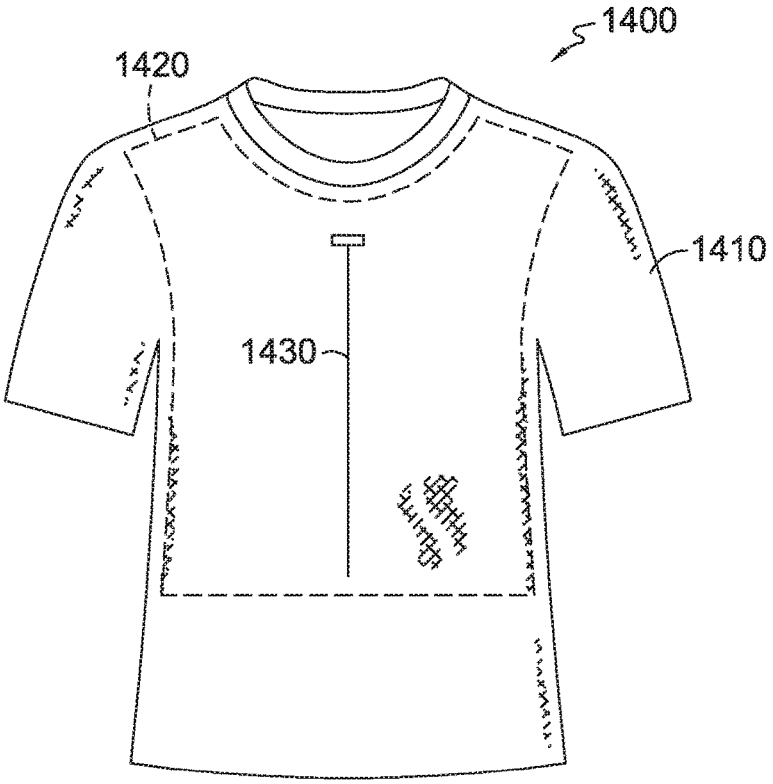
FIG. 14 depicts an upper body garment system having an exemplary coupled slider system, in accordance with aspects herein.

Similarly, FIG. 14 depicts an upper body garment system 1400 configured to reversibly provide tension, via the slider mechanism 1430, to a torso area of a wearer when the upper body garment system 1400 is worn via an internal layer 1420 located underneath external layer 1410, as indicated by the dashed lines. In accordance with aspects herein, although the slider mechanisms in the garment systems shown in FIGS. 1A-2B, and FIGS. 11-14 are shown to be at a particular location on the respective garment systems, it is contemplated that the respective slider mechanisms may be located at any suitable location on the respective garment systems, that is deemed most accessible and aesthetically appealing.

Figure 15:
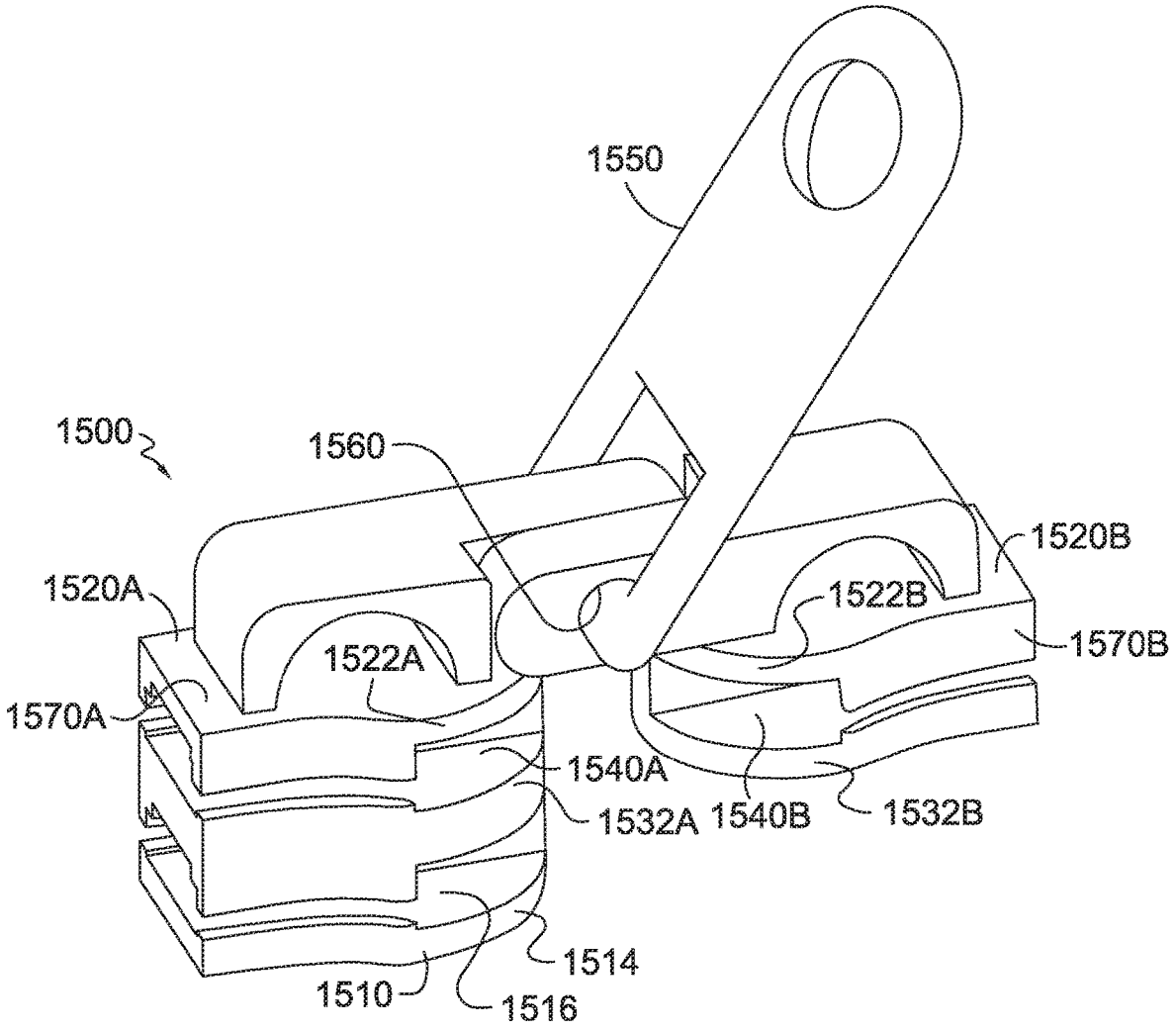
FIG. 15 depicts an exemplary structure for a coupled slider system, in accordance with aspects herein.

FIG. 15 depicts an exemplary structure for a slider system 1500 in accordance with aspects herein. The slider system 1500 comprises a first slider body 1520A facing a first direction and a second slider body 1520B facing a second direction opposite the first direction. The first slider body 1520A comprises a first slider component 1522A having a first slider opening 1540A configured to receive a first pair of slider elements (not shown) and a second slider component 1510 having a second slider opening 1516 configured to receive a second pair of slider elements (also not shown). The slider component 1510 and the slider component 1522A may comprise a monolithic construction (as shown) or a bi-partite construction by direct or indirect coupling (not shown). The slider components 1510 and 1522A may face the same direction (as shown), or may face opposite directions (not shown). The first slider body 1520A and the second slider body 1520B may be coupled to each other at the coupling region 1560. Further, the coupling region 1560 may be also configured to be further coupled to a slider pull 1560 on the slider system 1500.

The slider component 1510 is generally unidirectional and configured to open and close the second pair of slider elements (not shown), while the slider components 1522A and 1522B form a bi-directional slider component. The slider component 1510 and the bi-directional slider component formed by slider components 1522A and 1522B are mechanically coupled such that they act in unison in such a way that when the slider system 1500 is incorporated into an article, a directional force applied to the first slider body 1520A is transferred to the second slider body 1520B causing both the first slider body 1520A and the second slider body 1520B to concurrently move in the direction of the directional force.

The slider body 1520A may comprise an upper plate 1570A, a middle plate 1532A, and a bottom plate 1514; the slider body 1520B may comprise an upper plate 1570B and a bottom plate 1532B. The upper plate 1570A may cooperate with middle plate 1532A to form a passage 1540A, which is configured to accommodate the passage of a first set of slider elements between the upper plate 1570A and the middle plate 1532A. Similarly, the middle plate 1532A and the bottom plate 1514 may cooperate to form a passage 1516, which is configured to accommodate the passage of a second set of slider elements between the middle plate 1532A and the bottom plate 1514.

Continuing, the slider body 1520B may comprise an upper plate 1570B and a bottom plate 1532B. Similar to slider body 1520A, the upper plate 1570B and the bottom plate 1532B of the slider body 1520B form a passage 1540B, which is configured to accommodate the passage of the first set of slider elements between the upper plate 1570B and the bottom plate 1532B. It is to be noted that many different configurations for the slider system 1500 are available, as described with respect to FIGS. 4-7, and the one shown, is merely exemplary in nature.

Figure 16A:
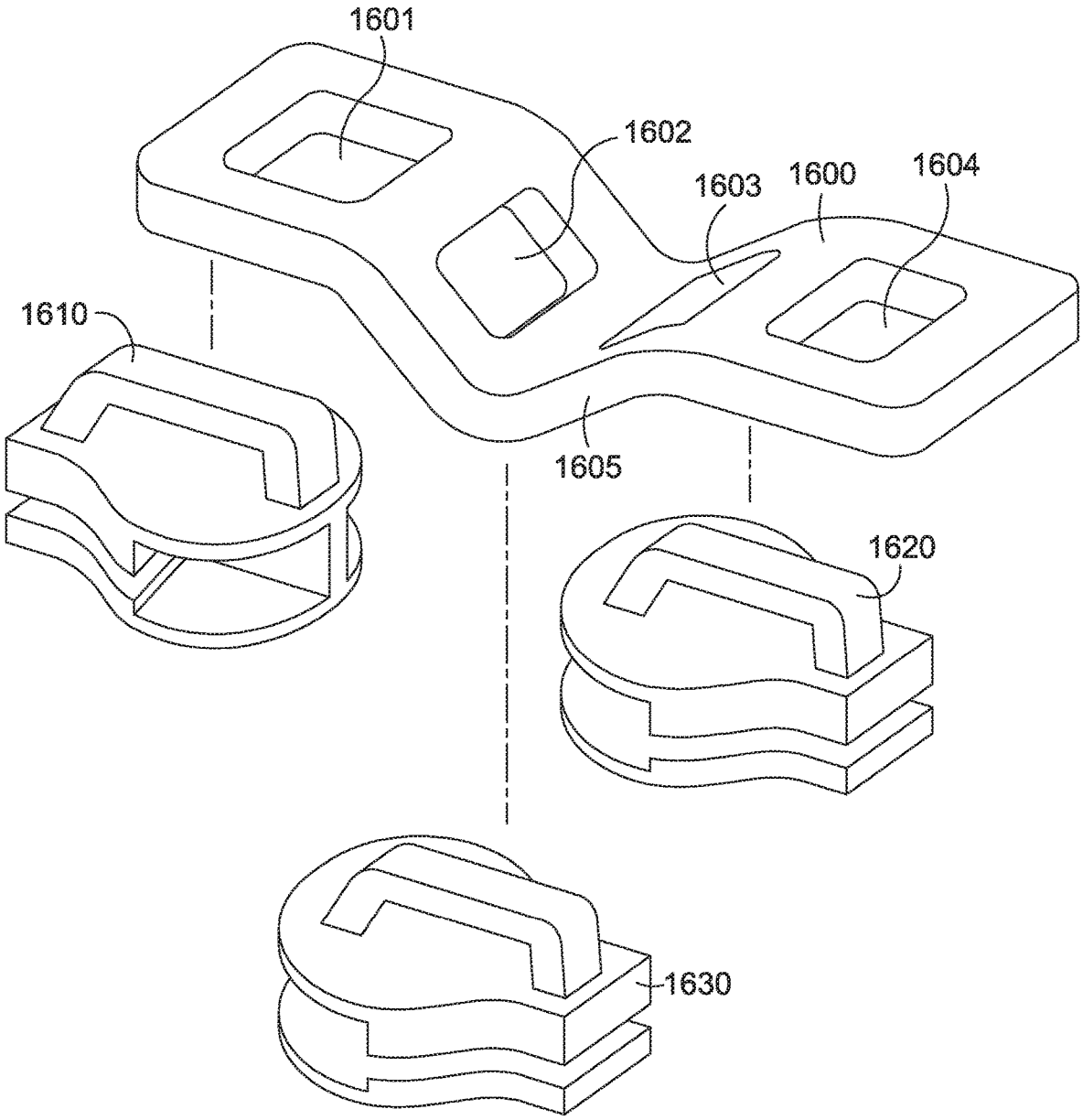
FIG. 16A depicts an adapter structure for conversion of conventional slider mechanisms into a coupled slider system, in accordance with aspects herein.
Figure 16B:
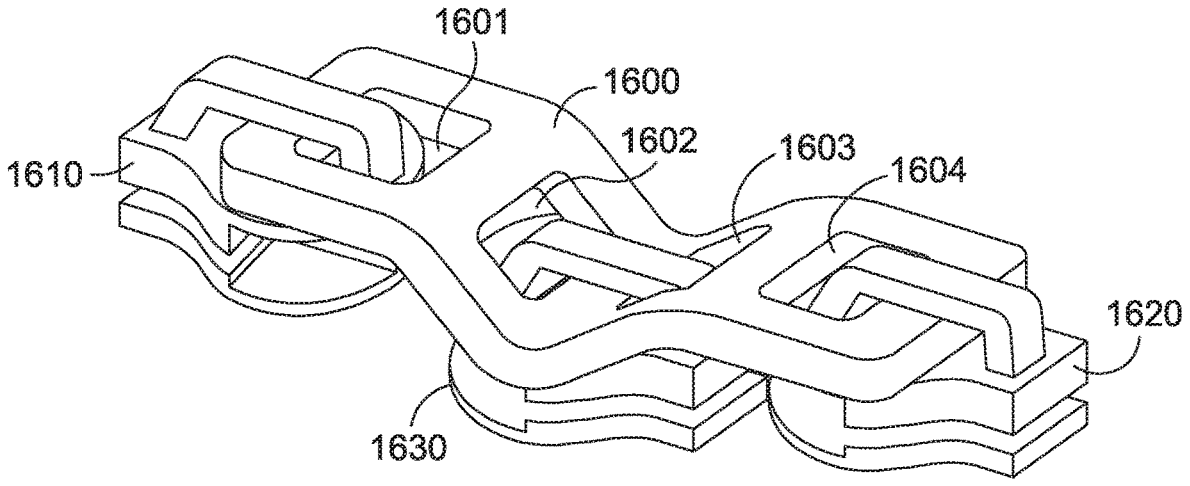
FIG. 16B depicts a coupled slider system employing the adapter structure shown in FIG. 16A, in accordance with aspects herein.
Figure 16C:
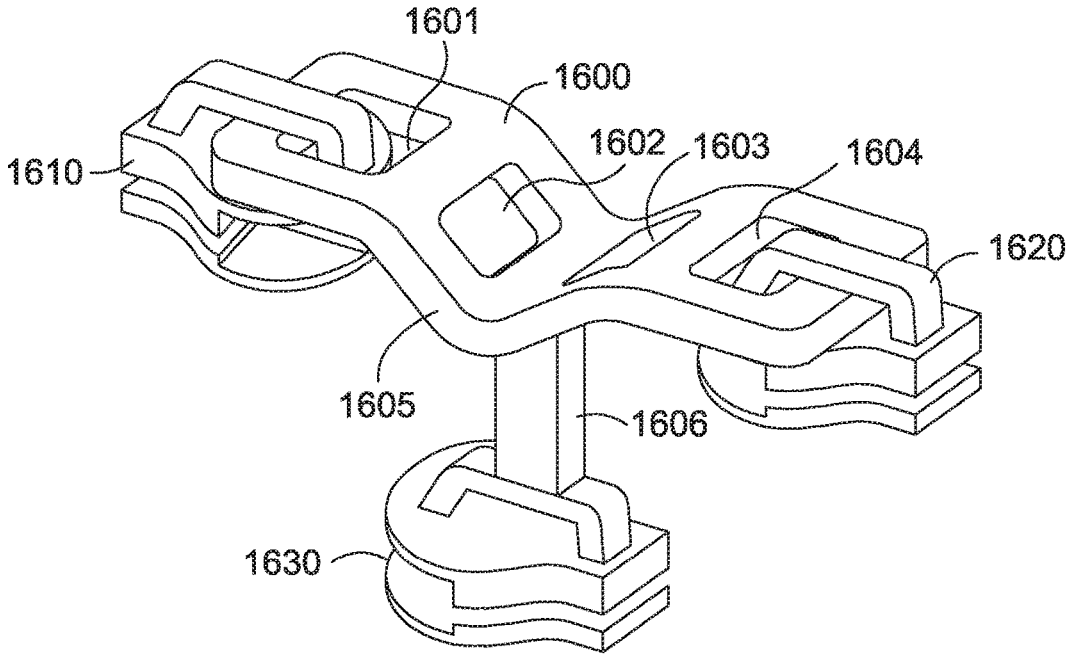
FIG. 16C depicts a different configuration employing an adapter structure in a coupled slider system, in accordance with aspects herein.

FIG. 16A depicts an adapter 1600 configured to convert conventional slider bodies, such as slider bodies 1610, 1620, and 1630 into a slider system in accordance with aspects herein. As further depicted in FIG. 16B, the slider bodies 1610, 1620, and 1630 may be mounted onto the adapter 1600, via openings 1601, 1602, 1603, and 1604 of the adapter 1600, as shown. The depth of the bend 1605 of adapter 1600 may define a separation or gap between the bi-directional slider system portion formed by slider bodies 1610 and 1620 and the unidirectional slider system portion formed by slider body 1630. Alternatively, as shown in FIG. 16C, the adapter 1600 may further comprise a spacer 1606 that creates a gap between the bi-directional slider system portion formed by slider bodies 1610 and 1620, and the unidirectional slider system portion formed by slider body 1630.

Figure 17:
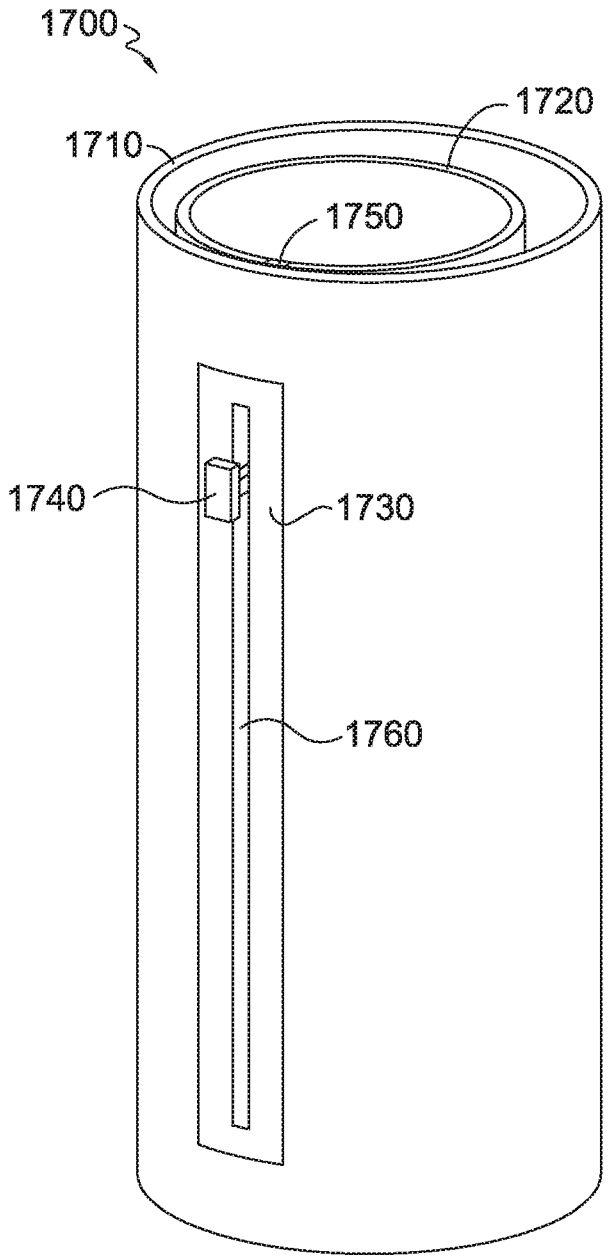
FIG. 17 depicts an exemplary alternative slider system for reversibly opening and closing a slider mechanism of an internal layer, in accordance with aspects herein.

FIG. 17 depicts yet another exemplary layered slider system 1700 in accordance with aspects herein where a slider system 1750 on an internal layer 1720 may be made accessible from an external layer 1710 via a slider pull 1740 for opening and closing the slider system 1750. The slider pull 1740, which activates the slider system 1750 on the internal layer 1720, is configured to outwardly protrude from a track 1730 located on the external layer 1710. The track 1730 may be comprised of a rigid or semi-rigid plastic or other suitable material that is configured to keep a guide opening 1760 from getting deformed or otherwise obstructed when the slider pull 1740 is used to open or close the slider system 1750 of the internal layer 1720.

The aspects described throughout this specification are intended in all respects to be illustrative rather than restrictive. Upon reading the present disclosure, alternative aspects will become apparent to ordinary skilled artisans that practice in areas relevant to the described aspects without departing from the scope of this disclosure. In addition, aspects of this technology are adapted to achieve certain features and possible advantages set forth throughout this disclosure, together with other advantages which are inherent. It will be understood that certain features and subcombinations are of utility and may be employed without reference to other features and subcombinations. This is contemplated by and is within the scope of the claims.

Since many different applications are available for the invention without departing from the scope thereof, it is to be understood that all matter herein set forth or shown in the accompanying drawings is to be interpreted as illustrative and not in a limiting sense.

Having thus described the invention, what is claimed is:

1. A garment system comprising:

an internal garment layer configured to reversibly apply pressure to a body part of a wearer when in a tensioned state;

an external garment layer positioned adjacent and exterior to the internal garment layer;

a first slider mechanism affixed to the internal garment layer, wherein when the first slider mechanism is in a closed state of the first slider mechanism, the internal garment layer is in the tensioned state, and wherein when the first slider mechanism is in an open state of the first slider mechanism, the internal garment layer is in a non-tensioned state; and a second slider mechanism affixed to the external garment layer and comprising at least a bi-directional slider body, the bi-directional slider body coupled to a first slider body of the first slider mechanism such that movement of the bi-directional slider body in a first direction causes the first slider mechanism to transition from the open state of the first slider mechanism to the closed state of the first slider mechanism and movement of the bi-directional slider body in a second direction opposite the first direction causes the first slider mechanism to transition from the closed state of the first slider mechanism to the open state of the first slider mechanism, wherein the second slider mechanism remains in a closed state of the second slider mechanism both when the bi-directional slider body is moved in the first direction and when the bi-directional slider body is moved in the second direction.

2. The garment system of claim 1, wherein the internal garment layer comprises an elastically resilient material.

3. The garment system of claim 1, wherein the first slider body of the first slider mechanism is coupled to a first set of slider elements, wherein the first slider body is configured to engage the first set of slider elements when moved in the first direction, and the first slider body is configured to disengage the first set of slider elements when moved in the second direction.

4. The garment system of claim 3, wherein the first set of slider elements comprises zipper teeth.

5. The garment system of claim 3, wherein the bi-directional slider body of the second slider mechanism is coupled with a second set of slider elements, wherein the second set of slider elements remain in an engaged state upon movement of the bi-directional slider body in the first direction and upon movement of the bi-directional slider body in the second direction.

6. The garment system of claim 5, wherein the first slider body of the first slider mechanism is mechanically coupled to the bi-directional slider body of the second slider mechanism.

7. The garment system of claim 1, wherein the garment system is one of an upper body garment, a lower body garment, or a body suit.

8. An article system comprising:

a first material layer having a first slider mechanism useable to transition at least a portion of the first material layer from a closed state to an open state and from the open state to the closed state; and a second material layer positioned adjacent and external to the first material layer, the second material layer having a second slider mechanism comprising at least a bi-directional slider body coupled to a first slider body of the first slider mechanism, wherein movement of the bi-directional slider body in a first direction causes the first slider mechanism to transition the portion of the first material layer from the closed state to the open state and wherein movement of the bi-directional slider body in a second direction opposite the first direction causes the first slider mechanism to transition the portion of the first material layer from the open state to the closed state, and wherein the second material layer remains closed when the bi-directional slider body is moved in the first direction and in the second direction.

9. The article system of claim 8, wherein the first material layer comprises a first modulus of elasticity and the second material layer comprises a second modulus of elasticity, wherein the second modulus of elasticity is greater than the first modulus of elasticity.

10. The article system of claim 9, wherein the first material layer is a compression layer configured to reversibly apply pressure to a body part of a wearer.

11. The article system of claim 10, wherein the first slider body of the first slider mechanism is coupled to a first set of zipper teeth.

12. The article system of claim 11, wherein the second slider mechanism comprises a second set of zipper teeth, wherein the bi-directional slider body of the second slider mechanism is coupled to the second set of zipper teeth, and wherein the second set of zipper teeth remain engaged when the bi-directional slider body is moved in the first direction and in the second direction.

13. The article system of claim 12, wherein the first slider body of the first slider mechanism is directly coupled to the bi-directional slider body of the second slider mechanism.

14. The article system of claim 12, wherein the first slider body of the first slider mechanism is indirectly coupled to the bi-directional slider body of the second slider mechanism by a spacer element.

15. A slider system incorporated into an article, the slider system comprising:

a first slider body coupled to a first set of slider elements; and a second slider body coupled to the first slider body and to a second set of slider elements, the second slider body comprising at least a first slider component facing a first direction and a second slider component facing a second direction opposite the first direction, wherein the second set of slider elements remain engaged when a first directional force is applied to the second slider body in the first direction faced by the first slider component and when a second directional force is applied to the second slider body in the second direction faced by the second slider component;

wherein the first directional force and the second directional force are transferred from the second slider body to the first slider body, causing the first set of slider elements coupled to the first slider body to engage when the second slider body is moved in the first direction, and causing the first set of slider elements of the first slider body to disengage when the second slider body is moved in the second direction.

16. The slider system of claim 15, wherein the first slider body comprises a first upper plate and a first bottom plate, and wherein the first slider body is configured to accommodate passage of the first set of slider elements between the first upper plate and the first bottom plate.

17. The slider system of claim 16, wherein the second slider body comprises a second upper plate and a second bottom plate, and wherein the second slider body is configured to accommodate a passage of the second set of slider elements between the second upper plate and the second bottom plate of the second slider body.

18. The slider system of claim 15, wherein the first slider body is directly or indirectly coupled to the second slider body.

19. The slider system of claim 15, wherein the second slider body comprises a monolithic construction.

20. The slider system of claim 19, wherein the second slider body comprises a bi-partite construction.

* * * * *